73-152 SR
2/18/86 OR 4,570,481

United States Patent [19]
McLaurin

[11] Patent Number: 4,570,481
[45] Date of Patent: Feb. 18, 1986

[54] INSTRUMENT LOCKING AND PORT BUNDLE CARRIER

[75] Inventor: Lauchlin A. McLaurin, Houston, Tex.

[73] Assignee: V.E. Kuster Company, Long Beach, Calif.

[21] Appl. No.: 648,685

[22] Filed: Sep. 10, 1984

[51] Int. Cl.[4] ..... E21B 49/00
[52] U.S. Cl. ..... 73/152
[58] Field of Search ..... 73/151, 152, 155; 175/40, 48, 50, 320; 367/81, 82; 403/202, 203

[56] References Cited

U.S. PATENT DOCUMENTS 2,411,696 11/1946 Silverman et al. ..... 340/856
2,659,046 11/1953 Arps ..... 175/48
3,690,166 9/1972 Grice ..... 73/152
3,853,184 12/1974 McCullough ..... 175/39
4,078,620 3/1978 Westlake et al. ..... 175/48
4,291,773 9/1981 Evans ..... 175/320
4,356,629 11/1982 Jeter et al. ..... 29/885

*Primary Examiner*—Stewart J. Levy
*Assistant Examiner*—Robert R. Raevis
*Attorney, Agent, or Firm*—Grant L. Hubbard; Kit M. Stetina; Bruce B. Brunda

[57] ABSTRACT

This invention provides a bundle carrier for deep drill stem testing in oil well drilling. The bundle carrier has an eccentric passage for permitting instruments and other apparatus to be passed therethrough during drilling and logging operations. A plurality of slots are formed in the thicker wall portion of the bundle carrier for receiving instrument bundles therein for making measurments of well borehole parameters. A locking device for securing measuring instruments in the slots and parts for communicating fluid to the measuring instrument are provided by this invention.

8 Claims, 8 Drawing Figures

INSTRUMENT LOCKING AND PORT BUNDLE CARRIER

BACKGROUND OF THE INVENTION

This invention relates to drill stem testing in oil and gas exploration which employ apparatus for placing instruments in a deep well bore in the earth for measuring parameters such as temperature and pressure.

It has been found that monitoring parameters such as temperature, pressure and flow rate provide useful information related to the type of material being drilled, drill bit wear, and presence of oil, natural gas or water in or adjacent the bore. Monitoring the above-mentioned parameters and characteristics of a well bore is generally referred to in the art as drill stem testing.

A difficulty associated with well logging is the requirement of removing the drill string to mount sensors thereto and then reinserting the drill string into the well bore. If more than one or two parameters are to be monitored, the problem is particularly exacerbated by the necessity of several removals and reinsertions of the drill string.

Apparatus used to introduce measuring and test instruments into well bores are known as bundle carriers. It would be desirable to use a bundle carrier which could simultaneously introduce a plurality of instruments into a well bore thereby minimizing the repetitive insertion and removal of the drill string. The bundle carrier is generally inserted into a drill string above the drill bit if simultaneous drilling and logging are to occur.

An especially difficult problem in well borehole logging is encountered in mounting instrument bundles to the exterior of a bundle carrier. The bundles and the mounting devices are exposed to the same environment as the exterior of the drill string, and must, therefore, have sufficient structural strength to prevent inadvertent removal and damage to the instruments during drilling operations. Previous instrument bundle carriers do not provide means for readily removing and replacing the instrument bundles in the field and are, therefore, inconvenient for use in many applications. Some previous bundle carriers have passages therein including sharply angled bends so that insertion of other instruments and equipment through such bundle carriers is very difficult and often impossible.

SUMMARY OF THE INVENTION

This invention is used in connection with a bundle carrier for carrying well borehole logging instruments that overcomes the deficiencies of prior art bundle carriers. The bundle carrier preferably includes an elongate body formed generally as a cylinder with an eccentric cavity formed therein. The eccentric cavity causes the bundle carrier body to have a thicker sidewall portion and a thinner sidewall portion. A plurality of longitudinal slots are formed in the thicker sidewall portion for carrying instrument bundles. Longitudinal pressure port passages extend from one end of the slots into the body of the bundle carrier to provide fluid communication between the interior of the bundle carrier and the instrument bundle.

According to this invention, radial passages provide fluid communication between the interior of the eccentric bore and the pressure port passages or between the well bore exterior to the drill string and the pressure port passages. The radial passages permit logging of drilling parameters inside and outside the drill string.

Also, according to this invention, one end of an instrument bundle is connected to a pressure port adapter, and the other end has a projection that extends into a corresponding cavity in a jig. The jig is formed to fit in the slot with the instrument bundle. The other end of the jig includes a projection that extends into a cavity at the end of the slot. A retaining ring has a notch that may be aligned with the cavity in the slot for insertion and removal of the jig. When the jig is inside the cavity, the retaining ring may be rotated to cover the end of the slot and the jig projection to securely retain the instrument bundle and the jig within the slot. The retaining ring preferably includes a pair of set screws for engagement in corresponding detents to prevent rotation of the retaining ring during drilling operations. The pressure port adapters, the jigs and the retaining ring cooperate to retain the instrument bundles in the slots.

DESCRIPTION OF THE PREFERRED EMBODIMENT

Figure 1:
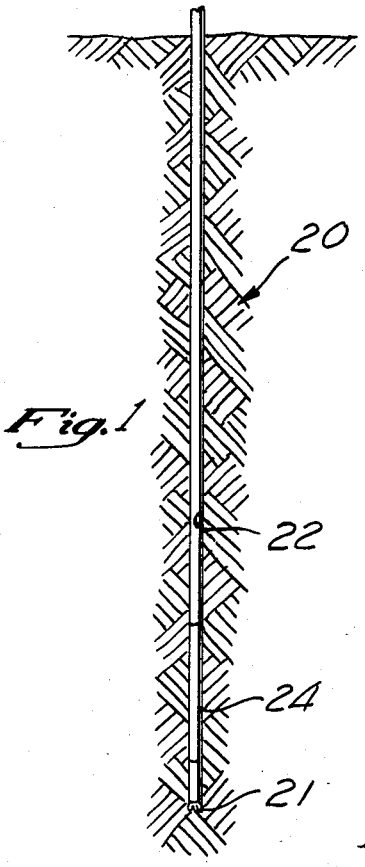
FIG. 1 schematically represents a drill string having a bundle carrier according to the invention inside a deep well bore in the earth.

Referring to FIG. 1, in deep subterranean drilling operations, a drill string 20 carrying a drill bit 21 extends into a well borehole 22. In order to monitor parameters such as temperature and pressure in the well borehole 22 during drilling operations, a bundle carrier 24 is mounted in the drill string 20 above the drill bit 21.

Figure 2:
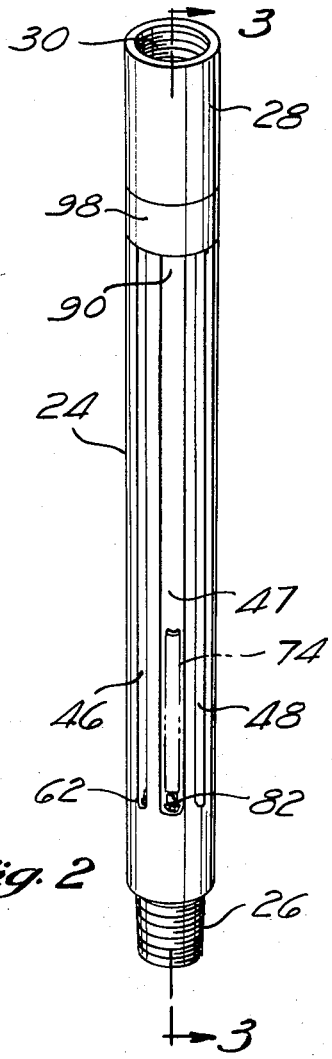
FIG. 2 is a perspective view illustrating the bundle carrier of the drill of FIG. 1 in an expanded scale.

Referring to FIG. 2, the bundle carrier 24 includes a first end 26 and a second end 28 having male and female threaded portions, respectively, for mounting the bundle carrier 24 in the drill string, which is preferably standard 5.5 inch outer diameter drill string piping with a central bore (not shown) having a diameter of about 2.25 inch. As shown in the hidden lines of FIG. 3, the bundle carrier 24 includes a first frustoconical portion 32 adjacent the end 26 and a second frustoconical portion 34 adjacent the end 28. The frustoconical portions 32 and 34 are concentric with and about the same diameter as the central bore 30 in the drill string 20. The bundle carrier 24 preferably includes an eccentric bore portion 36 that is about the same diameter as the central bore. A first transition section and a second transition section, respectively, are formed as part of portions 32 and 34 and smoothly connect the frustoconical portions 32 and 34 with the eccentric bore portion 36.

Figure 3:
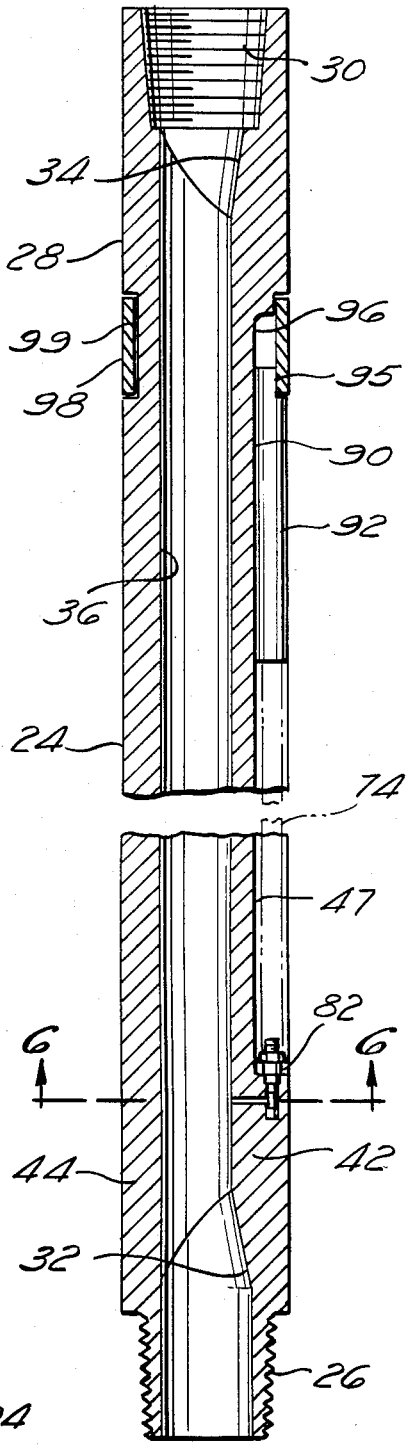
FIG. 3 is a cross-sectional view about line 3—3 of FIG. 2 illustrating a pressure port at one end of the bundle carrier of FIGS. 1 and 2 for providing fluid communication between the hollow interior of the bundle carrier and an instrument mounted in a slot therein for monitoring the well bore and showing a first bore portion concentric with the drill string and a second bore portion eccentric to the drill string.
Figure 6:
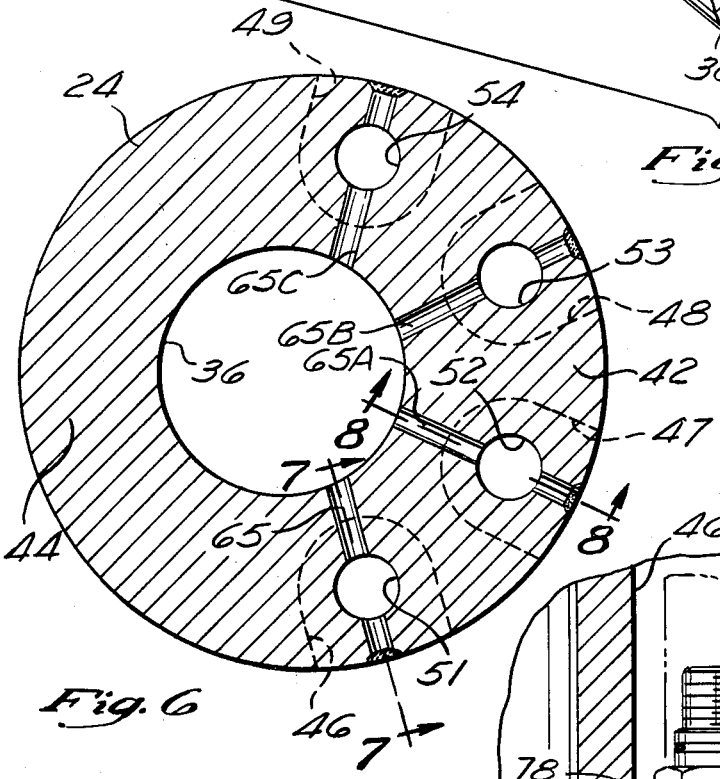
FIG. 6 is a cross-sectional view about line 6—6 of FIG. 3 showing passages between the slots and the eccentric bore.
Figure 7:
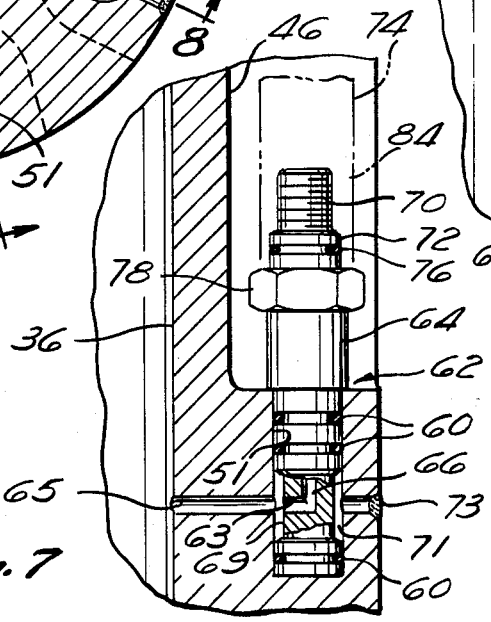
FIG. 7 is a cross-sectional view of the bundle carrier according to the invention including a first pressure port for placing an instrument in one of the slots in fluid communication with the eccentric bore of FIG. 3.

Referring to FIG. 3 and 6, the eccentricity of the bore portion 36 causes a first portion 42 of the sidewall of the bundle carrier 24 to have a greater thickness than a second portion 44. A plurality of slots 46–49 are formed in the thicker wall portion 42 in longitudinal alignment with the eccentric bore 36. The slots 46–49 are preferably formed by machining the cylindrical outer surface of the bundle carrier 24. As best shown in FIGS. 6 and 7, a plurality of passages 51–54 extend from the slots 46–49, respectively, into the bundle carrier 24 axially aligned with the eccentric bore 36. The passages 51–54 are preferably formed in the slots 46–49 at the lower ends, respectively by machining processes known in the art.

Referring to FIGS. 2 and 7, a pressure port 62 is inserted into the passage 51. The pressure port 62 has a generally cylindrical body 64 having a passage 66 therein. A plurality of O-rings 60 are mounted to the body 64 to form seals with the walls of the passage 51. The pressure port 62 includes a side inlet 63 extending into the passage 66 at a narrowed portion 69, which is inserted into the passage 51. A radical bore 65 extends between the eccentric bore 36 and the passage 51 to provide fluid communication therebetween. When the pressure port 62 is fully inserted into the passage 51, the narrowed portion 69 cooperates with the walls of the passage 51 to form a small void 71 that is in fluid communication with the interior of the eccentric passage 36. The radial bore 65 is formed by drilling through the bundle carrier near the end 26 at a location 73. The passage 65 is plugged at the outer surface of the bundle carrier 24 by any suitable means such as welding. As shown in FIG. 6, the passages 52, 53 and 54 have radial bores 65A, 65B and 65C that are substantially identical to the radial bore 65.

A male threaded fitting 70 extends from an end 72 of the pressure port 62 for threaded engagement with an instrument carrier 74 positioned within the slot 36. An O-ring 76 is preferably positioned between the fitting 70 and the body 64 to provide a seal when the instrument carrier 74 and the pressure port 62 are engaged in a manner suitable for use in drill stem testing. The pressure port 62 also preferably includes a hexagonal flange 78 suitable for engagement by a wrench, (not shown) to threadedly engage the fitting 70 and the instrument carrier 74. When fully assembled, the passage 51 and the corresponding pressure port 62 with side inlet 63 cooperate to provide fluid communication between the eccentric passage 36 and the instrument carrier 74 mounted in the slot 46.

The passages 52, 53 and 54 are formed to be substantially identical to the passage 51 and to receive therein pressure ports similar to the pressure port 62.

Figure 8:
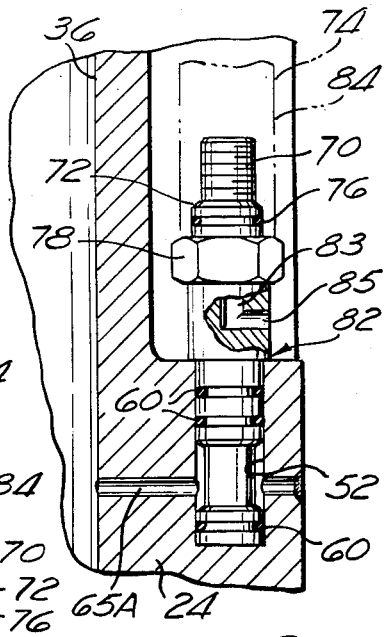
FIG. 8 is a cross-sectional view taken about line 8—8 of FIG. 6 showing a second pressure port for placing an instrument in fluid communication with the well bore exterior to drill string.

FIG. 8 illustrates a second pressure port 82 that may be inserted into the passage 52 for providing fluid communication between the well borehole 22 outside the bundle carrier 24 and drill string 20 and the instrument carrier 74. The pressure port 82 includes a passage 83 having a side inlet 85. The pressure port 82 includes the O-rings 60 and 76, the flanged portion 78 and the threaded portion 70 of the pressure port 82.

Figure 5:
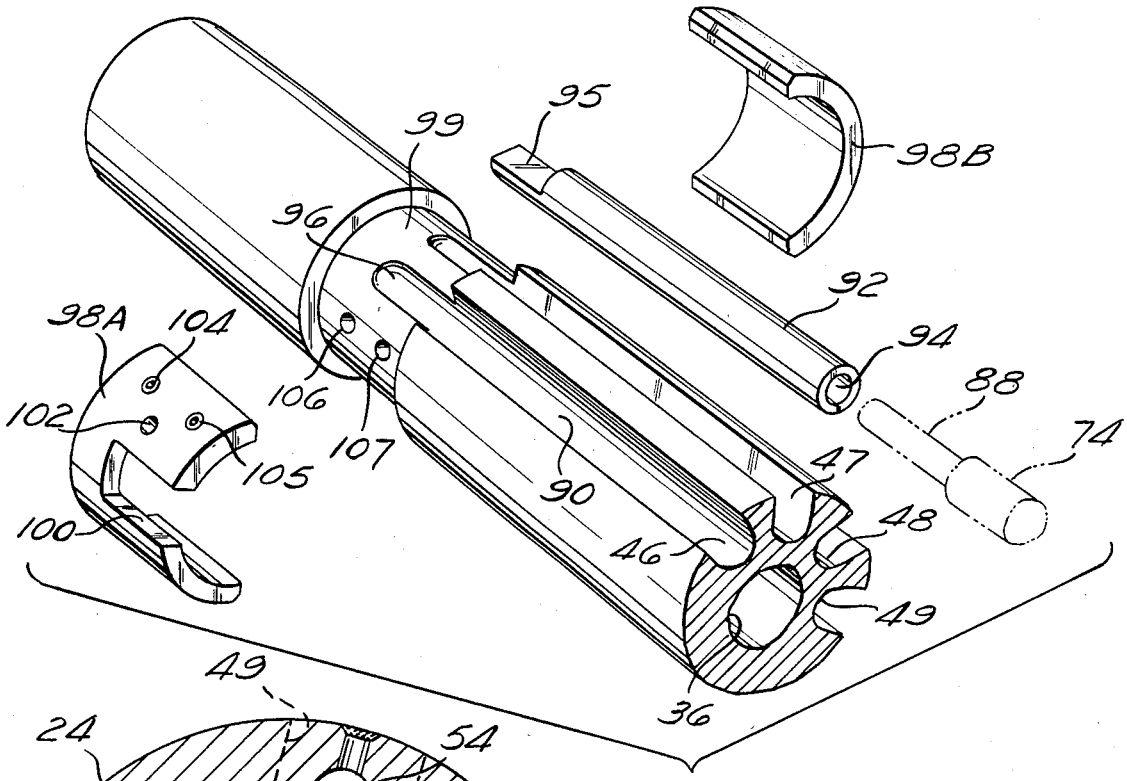
FIG. 5 is an exploded perspective view of the apparatus of FIG. 4.

The instrument carrier 74 is formed generally as an elongate cylinder having one end 84 threaded to engage one of the pressure ports 62 and 82. The other end of the instrument carrier 74 extends in its corresponding slot, for example, the slot 46 to a location near the end 28 of the bundle carrier 24. The instrument carrier 74 has a projection 88 extending therefrom toward the end 90 of the slot 46. As shown in FIG. 5, a jig 92 includes a cavity 94 formed to receive the projection 88. When the instrument carrier 74 and the jig 92 are positioned in the slot 46, a projection 95, which may be generally shaped as a semi-cylinder, extends into a cavity 96, which may be an extension of the slot 46.

A retaining ring 98 is preferably attached to a portion 99 of the bundle carrier 24 that has been machined to a reduced diameter. The retaining ring is preferably formed in two arcuate portions 98A and 98B, that are welded together to form the retaining ring 98 as an integral unit.

The retaining ring 98 is rotatably mounted to the bundle carrier 24 in a groove 99 that is preferably machined into the bundle carrier 24 adjacent the end 28 thereof. The retaining ring 98 includes a notch 100 having a width approximately equal to that of the slot 46 and the jig 92. The jig 92 with the instrument carrier 74 engaged therewith is placed in the cavity 46 with the projection 95 extending into the cavity 96 while the notch 100 is aligned therewith. After the jig 92 is in the desired position, the retaining ring 98 is rotated to cover the cavity 96 to retain the jig 92 and instrument carrier 74 in the slot 46. The retaining ring 98 is preferably formed of two portions 98A and 98B, best shown in FIG. 5, that are welded together.

The bundle carrier 24 as shown, comprises four slots 46–49 for holding instrument carriers. The ring 98 may have a plurality of angularly spaced notches 100 with a separate notch corresponding to each of the slots 46–49, which permits simultaneous locking of instrument carriers, such as the instrument carrier 74, into the bundle carrier 24. The retaining ring 98 may also have only the single notch 100, which simply requires that each of the slots 46–49 be loaded and locked in succession.

Figure 4:
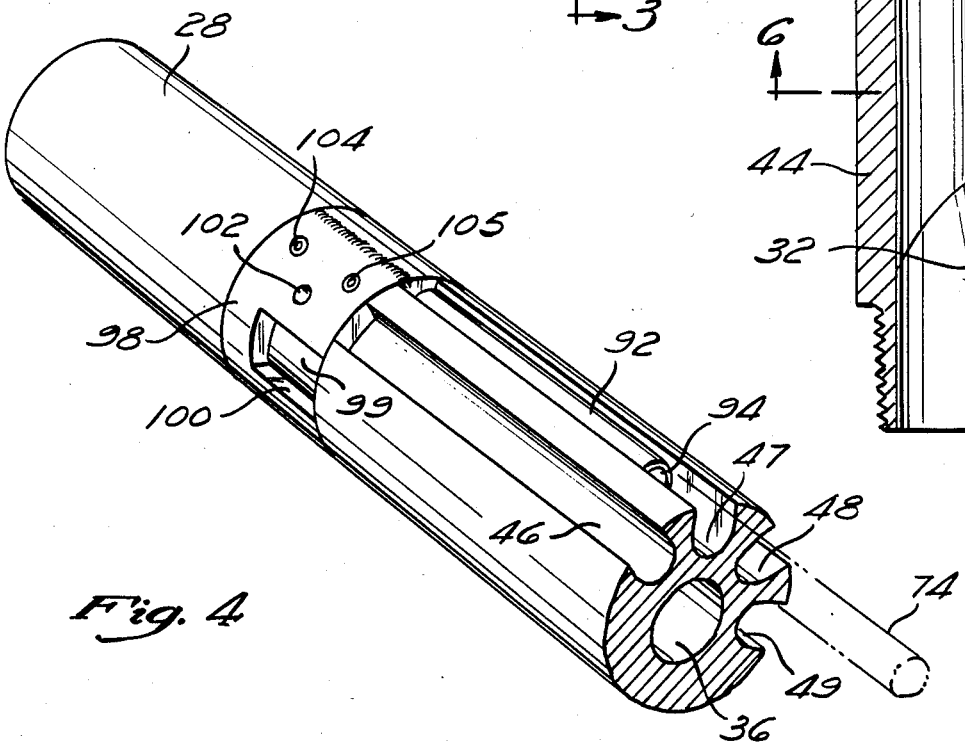
FIG. 4 is a perspective view of the other end of the bundle carrier.

As shown in FIGS. 4 and 5, the retaining ring 98 preferably includes a passage 102 configured for engagement with a generally cylindrical rod (not shown), which is then used as a wrench for rotating the retaining ring 98 to a desired position. Referring to FIG. 4, a pair of set screws 104–105 are positioned in the ring 98. When all of the cavities 96 at the ends of the notches 46–49 are covered by the ring 98, the set screws 104–105 may be aligned with a corresponding pair of recesses 106–107. The set screw 104–105 preferably are configured for being driven by means such as an Allen wrench, not shown, into the recesses 106–107 for retaining the ring 98 against rotation in the slot 99. The heads of the set screws 104–105 should not project outwardly of the curved surface of the retaining ring 98.

The eccentric bore 36 is a particularly important feature of the present invention. The outer diameter of the bundle carrier 24 cannot exceed the diameter of an ordinary drill string, which has a typical outside diameter of 5.5 inches. The minimum interior diameter of the eccentric bore 36 is 2.25 inch in order to accomodate instruments and other equipment normally used in drilling operations. Therefore, if the bore 36 were centered in the bundle carrier 24, the wall thickness thereof would be only 1.125 inch uniformly around the circumference. It has been found that for many instruments, a wall thickness of 1.125 inch is insufficient for forming the slots 46–49 and the corresponding ports 51–54 to provide flush mounting with the outer surface of the bundle carrier 24 while providing adequate structural strength to withstand the pressures and axial loads encountered in drill stem testing.

In the present invention, the slots 46–49 are formed in the thicker walled portion 42 of the bundle carrier 24, which affords ample space for carrying instruments without unacceptable reduction of the torsional strength. By providing the bundle carrier 24 with an eccentric bore 36 matched to the bore 30 of the drill string by the frustoconical portions 32 and 34, the present invention advantageously permits well bore logging during drilling operations and insertion of equipment and other instruments via a cable through the drill string 22 to the drill bit 21, if desired.

Typical dimensions for the bundle carrier 24 of the invention include a length of about 8 feet. The thinnest portion of the wall portion 44 is about 0.330 inch, and the thickest portion is about 1.625 inches. The instrument carrier 74 is typically about five feet long and about 1¼ inch in diameter. The slots 46–49 are sufficiently long to accommodate the five foot long instrument carrier 74 and the jig 92. The width of the slots is slightly greater than the 1¼ inch outer diameter of the bundle carriers 74, that they may be easily inserted into the slots 46–49 and removed therefrom.

Although the present invention has been described with reference to a particular preferred embodiment, it is to be understood that those skilled in the art may made numerous modifications of the preferred embodiment without departing from the scope and spirit of the invention. Accordingly, all modifications and equivalents that are within the scope and spirit of the invention are included in the claims appended hereto.

What is claims is:

1. A bundle carrier for insertion in a drill string carrying a bundle of well logging instruments during drilling operations, comprising:

a generally cylindrical body;

a longitudinal slot formed in the outer surface of the body for receiving an instrument bundle;

means for engaging a first end of the instrument bundle to retain it in the slot;

a jig for engaging a second end of the instrument bundle; and a retaining ring having a notch therein for selective alignment with the slot for admitting a portion of the jig therethrough, the retaining ring being rotatable upon the body to misalign the slot and notch to retain the jig and instrument bundle in the slot.

2. The bundle carrier of claim 1 wherein the body includes a longitudinal cavity therein and a passage between the slot and the longitudinal cavity, further comprising a pressure port adapter having a first end configured for insertion into the passage and a second end configured for attachment to the instrument bundle, the pressure port adapter further including a passage for placing the instrument bundle in fluid communication with the longitudinal cavity for monitoring selected well borehole parameters.

3. The bundle carrier of claim 2 further including a plurality of exterior longitudinal slots for carrying well logging instruments, a passage between each slot and the longitudinal cavity, each slot including one of the pressure port adapters.

4. The bundle carrier of claim 1 wherein the body includes a longitudinal cavity therein and a passage between the slot and the longitudinal cavity, further comprising a pressure port adapter having a first end configured for insertion into the passage and a second end configured for attachment to the instrument bundle, the pressure port adapter further including a passage therethrough for placing the instrument bundle in fluid communication with the well borehole exterior to the central cavity.

5. The bundle carrier of claim 4 further including a plurality of exterior longitudinal slots for carrying well logging instruments, a passage between each slot and the central cavity, each slot including one of the pressure port adapters.

6. The bundle carrier of claim 3, wherein the pressure port adapter includes the means for engaging a first end of the instrument bundle to retain it in the slot.

7. The bundle carrier of claim 6 wherein the jig includes a bore therein; and the instrument bundle includes a projection for insertion in the jig bore when the jig and instrument bundle are mounted within one of the slots.

8. The bundle carrier of claim 1 further including means for locking the retaining ring to prevent inadvertent removal of the instrument bundle from the slot.

* * * * *